United States Patent [19]

Kwan

[11] 4,249,123

[45] Feb. 3, 1981

[54] TEMPERATURE COMPENSATED REFERENCE VOLTAGE REGULATOR

[75] Inventor: Stephen C. Kwan, Plano, Tex.

[73] Assignee: Texas Instruments Incorporated, Dallas, Tex.

[21] Appl. No.: 954,671

[22] Filed: Oct. 25, 1978

Related U.S. Application Data

[63] Continuation of Ser. No. 737,134, Oct. 29, 1976, abandoned.

[51] Int. Cl.[2] ..... G05F 1/60

[52] U.S. Cl. ..... 323/314; 323/907

[58] Field of Search ..... 307/297, 299 B; 323/4, 323/19, 22 T; 58/23 BA

[56] References Cited

U.S. PATENT DOCUMENTS 3,893,017 7/1975 Williams ..... 323/9

OTHER PUBLICATIONS

IEEE Journal of Solid State Circuits, vol. SC-11, No. 3, pp. 403-406, Jun. 1976 (S6159 0215w).

*Primary Examiner*—William H. Beha, Jr.

*Attorney, Agent, or Firm*—Jeffrey Van Myers; Melvin S. Sharp; Richard L. Donaldson

[57] ABSTRACT

A differential reference voltage regulator for I²L silicon integrated circuits having temperature compensation means including a temperature reference transistor and a balance resistance, R2, connected in series between a reference resistance, R1, and a current source transistor wherein $$\frac{R2}{R1} = \frac{22.63}{\ln(n)} - 1$$

where n is the ratio of currents applied to a pair of transistors which form a differential regulator.

3 Claims, 3 Drawing Figures

TEMPERATURE COMPENSATED REFERENCE VOLTAGE REGULATOR

This is a continuation, of application Ser. No. 737,134, filed Oct. 29, 1976, now abandoned.

Reference voltage regulator circuits included in low-power low-voltage integrated circuit devices are well known in the prior art. Such regulator circuits are often embodied, for example, as part of the integrated circuit of a solid state wristwatch or a solid state camera control as well as in integrated circuits for other purposes. The purpose of such reference voltage regulator circuits is to insure the operating circuit of the device a constant voltage or current supply despite changing load conditions or primary supply (battery) voltage changes. One such prior art circuit is the subject of U.S. Pat. No. 3,893,017 of C. R. Williams. Many prior art reference regulator circuits have been found disadvantageous because of their temperature sensitivity, their limited ability to supply output current and their inability to operate from primary voltage sources near the magnitude of their regulated output voltage.

The present invention is a reference voltage regulator circuit implemented in integrated injection logic form for use in low-power low-voltage integrated circuits. The regulator of the present invention is temperature compensated and capable of operating from a primary source voltage which is only 8 to 10 percent higher than the desired regulated voltage output.

It is one object then of the present invention to provide a temperature compensated reference voltage regulator circuit.

It is a further object of the present invention to provide a reference voltage regulator circuit capable of providing a regulated reference voltage which is as much as 90 percent of the primary source voltage.

These and other objects and advantages of the present invention will be obvious from the following detailed description when read in conjunction with the accompanying drawings in which.

Figure 1:
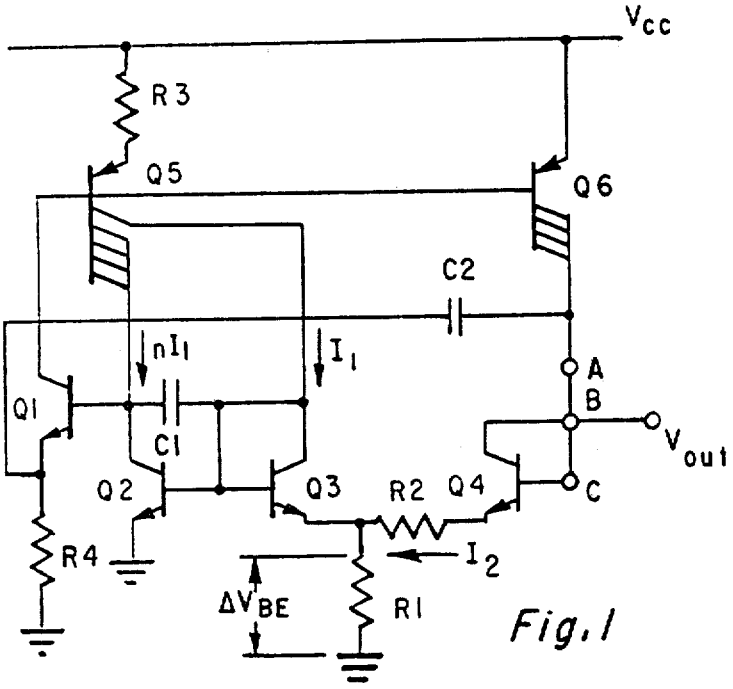
FIG. 1 is a schematic diagram of one embodiment of the regulator circuit of the present invention.

Referring now to FIG. 1 there is shown a schematic diagram of the voltage reference regulator circuit of the present invention. As can be seen from the schematic, the circuit is well adapted to be embodied in an integrated circuit of the integrated injection logic ($I^2L$) type. Thus, drive transistors Q1, Q2, and Q3, and temperature references transistor Q4 are npn transistors and transistors Q5 and current souce Q6 are pnp types although all of these types could be reversed with appropriate reversal of voltage polarities as is well known. Further, current source transistors Q5 and Q6 are illustrated as multiple collector transistors but it is understood their function could be carried out by multiple transistors. Current source transistors Q5 and Q6 function as current sources to provide a first current, $I_1$, a second current, $I_2$, and a third current, $nI_1$, where n is greater than unity. The emitter of current source transistor Q5 is connected through a current limiting resistor R3 to a voltage source ($V_{cc}$) such as a battery and the emitter of current source transistor Q6 is connected directly to the same voltage source. The bases of current source transistors Q5 and Q6 are connected together and to the collector of drive transistor Q1. The emitter of drive transistor Q1 is coupled to the other terminal of the voltage source, shown here as ground, through a resistor R4 and to the collector of current source transistor Q6 through capacitor C2. The base of drive transistor Q1 is connected to the collector of drive transistor Q2, one terminal of capacitor C1 and one or more collectors of current source transistor Q5. The emitter of drive transistor Q2 is connected to ground. The base and collector of drive transistor Q3, the base of drive transistor Q2, the second terminal of capacitor C1 and one or more additional collector terminals of current source transistor Q5 are connected in common. The emitter of drive transistor Q3 is coupled through a reference resistor R1 to ground. Also connected to the emitter of drive transistor Q3 through a balance resistor R2 is the emitter of temperature reference transistor Q4. The base of temperature reference transistor Q4 is connected to a junction point C and the collector of temperature reference transistor Q4 is connected to a junction point B. One of more collectors of current source transistor Q6 are connected to a junction point A. In the embodiment of FIG. 1 junction A, B, and C are all connected together. The regulated reference voltage output ($V_{out}$) is taken at junction point B in all embodiment. It should be noted that resistor R4 and capacitors C1 and C2 are optional and are used only to improve the ac stabilization of the circuit.

In prior art systems of this type the circuit acted to hold the current through, and thus the voltage across, reference resistor R1 constant. Since the voltage across reference resistor R1 is always equal to the difference in the base-emitter voltage drops of drive transistors Q2 and Q3, $\Delta V_{BE}$, it is established by the resistance of reference resistor R1 and the ratio, n, of the third current, $nI_1$, to the first current, I, respectively. In operation the third current, is usually chosen to be much larger than the first current $I_1$ by choice of the geometry and number of current source transistor Q5 collectors connected in the two individual current paths respectively as is well known. For example, n may be chosen to be from about 2 to about 20 or 30.

As in the operation of the prior art circuit shown in the above-mentioned U.S. Pat. No. 3,893,017, the reference voltage established by the reference resistor R1 at the emitter of drive transistor Q3 would ordinarily be subject to considerable variation with temperature. In the present invention the combination of temperature reference transistor Q4 and balance resistor R2 is used to compensate for this change.

The voltage at the $V_{out}$ terminal is equal to the sum of the voltage drops across the reference resistor R1, the balance resistor R2 and the base-emitter voltage, $V_{BE(4)}$, of the temperature reference transistor Q4. The voltage across resistor R1 is equal to the resistance of reference resistor R1 times the current through it, i.e. $\Delta V_{BE}=R1\ ((I_1+I_2)$. However, if $I_2$ is made much, much larger than $I_1$ then $\Delta V_{BE}$ can be assumed to be essentially equal to the product $R_1I_2$.

Since $\Delta V_{BE}$ may be expressed as $KT/q\ \ln(n)$ then $I_2$ is approximately equal to $KT/qR_1\ \ln(n)$.

Then $V_{out} = I_2(R_1 + R_2) + V_{BE(Q4)}$ $$= \frac{KT}{q} \ln(n)\left(1 + \frac{R_2}{R_1}\right) + V_{BE(Q4)}$$

If $V_{out}$ is to remain constant over a range of temperatures, where K is Boltzmann's constant, T is the absolute temperature in degrees kelvin, q is the charge in coulombs and n is the ratio of the third and first currents.

$$\frac{\delta V_{out}}{\delta T} = 0, \text{ then:} \quad (1)$$

$$\frac{K}{q} \ln(n.\left[1 + \frac{R_2}{R_1}\right] = -\left[\frac{\delta}{\delta T} V_{BE(Q4)} + \left(\frac{\delta V_{BE(Q4)}}{\delta I_2}\right)\left(\frac{\delta I_2}{\delta T}\right)\right]$$

$\frac{\delta}{\delta T} V_{BE(Q4)}$ for silicon is $-2$mv/°c, $\frac{\delta V_{BE(Q4)}}{\delta I_2} = \frac{KT}{qI_2}$ and $$\frac{\delta I_2}{\delta T} = \frac{\delta}{\delta T}\left(\frac{\Delta V_{BE}}{R_1}\right)$$

$$= \Delta V_{BE}\left(-\frac{1}{R_1^2}\right)\frac{\delta R_1}{\delta T} + \frac{1}{R_1}\frac{\delta}{\delta T}\Delta V_{BE}$$

$$= -\frac{\Delta V_{BE}}{R_1}\frac{\delta R_1/\delta T}{R_1} + \frac{1}{R_1}\frac{K}{q}\ln(n)$$

Since $\Delta V_{BE}/R_1$ is the initial value of $I_2$ $$\frac{\delta I_2}{\delta T} = -I_2\frac{\delta R_1/\delta T}{R_1} + \frac{K}{qR_1}\ln(n)$$

Substituting in Equation (1)

$$\frac{K}{q}\ln(n)\left[1 + \frac{R_2}{R_1}\right] = \quad (2)$$

$$-\left[-2\text{mv}/^\circ c + \left(\frac{KT}{qI_2}\right) - \left(I_2\frac{\delta R_1/\delta T}{R_1} + \frac{K}{qR_1}\ln(n)\right)\right]$$

$$= -\left[-2\text{mv}/^\circ c - \frac{KT}{q}\frac{\delta R_1/\delta T}{R_1} + \frac{K^2T}{q^2I_2R_1}\ln(n)\right]$$

$$= -\left[-2\text{mv}/^\circ c - \frac{KT}{q}\frac{\delta R_1/\delta T}{R_1} + \frac{K}{q}\left(\frac{KT/q}{I_2R_1}\ln(n)\right)\right]$$

$$= -\left[-2\text{mv}/^\circ c - \frac{KT}{q}\frac{\delta R_1/\delta T}{R_1} + \frac{K}{q}(I)\right]$$

In silicon $\frac{KT}{q} = 26$ mv at 300° K.

-continued $$\frac{\delta R_1/\delta T}{R_1} \approx 0.15\%/^\circ c \text{ and}$$

equation (2) becomes:

$$\frac{K}{q}\ln(n)\left[1 + \frac{R}{R}\right] = 2\text{mv}/^\circ c + 26\text{mv}(0.0015/^\circ c) - 86.3\mu\text{v}/^\circ c$$

$$= 1.9527 \text{ mv}/^\circ c$$

$$\ln(n)\left[1 + \frac{R_2}{R_1}\right] = \frac{1.9527\text{mv}/^\circ c}{86.3\mu\text{v}/^\circ c} = 22.63$$

thus for "constant" $V_{out}$ over a range of temperatures, it can be seen that the ratio of $R_2$ to $R_1$ depends on the ratio of the third and first currents. For example, when n is chosen as 2, $R_2/R_1$ should be 31.66; when n is equal to 4, $R_2/R_1$ should be 15.33; when n is equal to 8, $R_2/R_1$ should be 9.88; at n=12 $R_2/R_1$ should be 8.107; and if n is equal to 16, $R_2/R_1$ should be 7.162.

Figure 2:
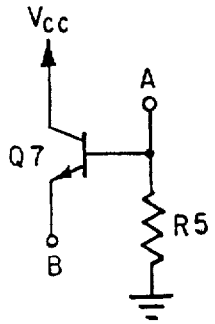
FIG. 2 illustrates a modification of the circuit of FIG. 1 providing a greater output current capability.
Figure 3:
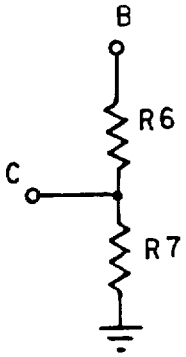
FIG. 3 illustrates a further modification of the circuit of the present invention providing higher output voltage capability.

Should more output current be desired from the regulator of the present invention, the link between junction points A and B may be removed and the circuit of FIG. 2 comprising amplifying transistor Q7 and resistor R5 inserted as indicated. Should a higher output voltage be desired, the resistor network of R6 and R7 of FIG. 3 may be inserted in the place of the link between junction points B and C as indicated. $V_{out}$ would then equal the voltage at the base of temperature reference transistor Q4, $V_c$ $(1+R_6/R_7)$. Of course the circuits on both FIGS. 2 and 3 could be inserted simultaneously into the circuit of FIG. 1.

The effectiveness of the temperature compensation of the circuit of the present invention is demonstrated by the following test results of the circuit of FIG. 1 as modified by the circuit of FIG. 2 wherein $V_{cc}$ equals 5 volts, $R_1+R_2=10$ kohms, $R_3=12$ kohms, $R_4=2$ kohms, $R_5=16$ kohms, and n=6. The output voltage ($V_{out}$) was taken across a 6.2 kohms resistor between junction point B and ground.

| Temp (°C.) | $\Delta V_{BE}$ (mv) | $V_{out}(R_2/R_1 = 11.79)$ (V) | $V_{out}(R_2/R_1 = 13.015)$ (V) | $V_{out}(R_2/R_1 = 12.4025)$ (V) |
|---|---|---|---|---|
| −35 | 37.7 | 1.224 | 1.272 | 1.248 |
| −25 | 39.2 | 1.223 | 1.273 | 1.247 |
| −15 | 40.8 | 1.222 | 1.273 | 1.246 |
| 0 | 43.4 | 1.220 | 1.273 | 1.246 |
| +15 | 45.5 | 1.217 | 1.274 (est) | 1.246 |
| +25 | 47.0 | 1.216 | 1.275 | 1.246 |
| +35 | 48.4 | 1.215 | 1.275 (est) | 1.245 |
| +45 | 50.1 | 1.214 | 1.276 | 1.245 |
| +55 | 51.7 | 1.213 | 1.277 | 1.245 |
| +65 | 53.4 | 1.212 | 1.278 | 1.24 |

Thus, there has been disclosed a reference voltage regulator circuit which is compensated to have a nearly constant voltage output over a wide temperature range and is capable of greater current output and a regulated voltage closer to supply voltage than circuits of the prior art.

Many changes and modifications still within the spirit and scope of the present invention will occur to those skilled in the art. Therefore, this invention is to be limited as set forth in the following claims.

What is claimed is:

1. A temperature compensated reference voltage regulator comprising:

current source transistor means for providing a first current, a second current, and a third current n times greater than the first current, where n is greater than unity, each of the first, second and third currents being proportional to an applied drive current;

first drive transistor means for applying drive current to the current source transistor means in proportion to an applied drive current;

second drive transistor means for applying a portion of the third current as drive current to the first drive transistor in proportion to an applied drive current;

third drive transistor means for applying a portion of the first current as drive current to the second drive transistor means in proportion to an applied reference voltage;

reference resistance means for applying a reference voltage to the third drive transistor means in proportion to an applied reference current; and temperature compensation means for applying a portion of the second current as reference current to the reference resistance means in proportion to the temperature of the temperature compensating means, wherein the temperature compensation means comprises a temperature reference transistor means and a balancing resistance means connected in series to apply the second current provided by the current source transistor means to the reference resistance means, the temperature reference transistor means having a $V_{BE}$ proportional to the temperature thereof, and the balancing resistance means having a resistance ratio to the reference resistance means of about $$\frac{22.63}{\ln(n)} - 1.$$

2. The regulator of claim 1 wherein the temperature compensation means further comprises resistance means connected to the temperature reference transistor means to limit the flow of the second current through the temperature reference transistor means.

3. The regulator of claim 1, or 2 further comprising:

amplifing transistor means interposed between the current source transistor means and the temperature compensation means for amplifing the second current applied to the temperature compensation means.

* * * * *